United States Patent [19]

Quinby

[11] 4,072,501

[45] Feb. 7, 1978

[54] METHOD OF PRODUCING HOMOGENEOUS MIXED METAL OXIDES AND METAL-METAL OXIDE MIXTURES

[75] Inventor: Thomas C. Quinby, Kingston, Tenn.

[73] Assignee: The United States of America as represented by the United States Department of Energy, Washington, D.C.

[21] Appl. No.: 787,128

[22] Filed: Apr. 13, 1977

[51] Int. Cl.[2] ..... B22F 1/02; C21C 15/00; C22B 5/02; C22C 43/00

[52] U.S. Cl. ..... 75/.5 BC; 75/.5 A; 75/.5 AA; 75/.5 B; 75/.5 BA; 252/301.1 W; 423/11; 423/42; 423/50; 423/55; 423/65; 423/81; 423/92; 423/101; 423/122; 423/143; 423/158; 423/194; 423/85; 423/592; 423/594; 423/596; 423/643

[58] Field of Search ..... 75/.5 A, .5 AA, .5 AB, 75/.5 AC, .5 B, .5 BA, .5 BB, .5 BC, 108; 423/11, 12, 13, 14, 15, 596, 81, 592, 593, 594, 643, 21, 22, 42, 50, 55, 65, 85, 92, 122, 143, 158, 194; 252/301.1 W, 301.1 R

[56] References Cited

U.S. PATENT DOCUMENTS

| | | | |
|---|---|---|---|
| 3,669,632 | 6/1972 | Kanij et al. | 252/301.1 S |
| 3,778,380 | 12/1973 | Baker et al. | 252/301.1 R |
| 3,862,908 | 1/1975 | Fitch et al. | 423/55 |
| 3,962,114 | 6/1976 | Berreth | 252/301.1 W |
| 4,010,242 | 3/1977 | Iler et al. | 423/592 |

FOREIGN PATENT DOCUMENTS

| | | | |
|---|---|---|---|
| 525,200 | 3/1952 | Canada | 75/.5 B |
| 38-7706 | 1/1963 | Japan | 423/81 |

*Primary Examiner*—L. Dewayne Rutledge
*Assistant Examiner*—Michael L. Lewis
*Attorney, Agent, or Firm*—Dean E. Carlson; Stephen D. Hamel; Allen H. Uzzell

[57] ABSTRACT

Metal powders, metal oxide powders, and mixtures thereof of controlled particle size are provided by reacting an aqueous solution containing dissolved metal values with excess urea. Upon heating, urea reacts with water from the solution leaving a molten urea solution containing the metal values. The molten urea solution is heated to above about 180° C whereupon metal values precipitate homogeneously as a powder. The powder is reduced to metal or calcined to form oxide particles. One or more metal oxides in a mixture can be selectively reduced to produce metal particles or a mixture of metal and metal oxide particles.

10 Claims, No Drawings

METHOD OF PRODUCING HOMOGENEOUS MIXED METAL OXIDES AND METAL-METAL OXIDE MIXTURES

BACKGROUND OF THE INVENTION

This invention was made in the course of, or under, a contract with the United States Energy Research and Development Administration. It relates in general to the preparation of powders and, more particularly, to the preparation of finely divided metal, oxide, and metal-metal oxide mixtures. Finely divided metal powders are useful in conventional powder metallurgical techniques. Finely divided oxide powders are useful in the manufacture of coating compositions, intricately shaped and fine-grained ceramics, cermets, etc. Small particles and particularly important in the preparation of powder mixtures. In general, the smaller the particle size, the more uniform are the compositions and mechanical properties of metal, ceramic and cermet articles prepared from the powder mixtures.

Small oxide and metal particles are particularly useful in the manufacture of nuclear components. For example, the nuclear properties of ceramic or cermet neutron absorbers are directly related to the uniformity of composition of a material. The neutron dosimeter wires described in commonly assigned U.S. Pat. No. 3,971,944 contain as little as 0.1 wt. % of a target oxide in a diluent oxide. These oxide wires are extruded from an oxide powder mixture containing a binder. To ensure reproducible measurements, the composition in such wires must have a variance no more than + 1 wt. % at the 95% confidence level along the length of the wire. In order to ensure this uniformity at low target oxide concentrations, the oxide particles should be very small, e.g. 0.2–0.5 micron in diameter (equivalent area diameter).

PRIOR ART

In the prior art, powder mixtures have been provided by many well-known methods such as physical grinding, coprecipitation from solutions, etc. In coprecipitation processes, particle size is typically regulated by controlling mixing speed, digesting time, temperature, etc. The particles generally must be separated from the solvent by filtration, etc., because evaporation of solvent would ordinarily result in an increase in particle size during heating. For example, when metal nitrate solutions are evaporated to dryness, the particles are typically 100 microns in diameter. The separation of small particles from the solvent often requires the use of agglomerating or flocculating agents and centrifugation. In addition, it is sometimes difficult to precipitate particles of different compounds homogeneously.

SUMMARY OF THE INVENTION

It is an object of this invention to provide a method for preparing particles of controlled particle size without a filtration or centrifugation step.

It is a further object to provide a method for preparing mixtures of fine particles.

It is a further object to provide a process for preparing uniform mixtures of oxide particles for use in preparing uniform mixed oxide ceramics.

It is a further object to provide a powder mixture for the preparation of cermets having a uniform dispersion of oxide particles.

It is a further object to provide a powder mixture useful in a method for immobilizing radioactive waste metal values as oxides within a non-radioactive metallic or metal oxide matrix.

These and other objects are provided according to this invention in a method for preparing particulate metal or metal oxide of controlled particle size comprising contacting an aqueous solution containing dissolved metal values with excess urea at a temperature sufficient to cause urea to react with water in said aqueous solution to provide a molten urea solution containing said metal values; heating said molten urea solution containing metal values to cause said metal values to precipitate, forming a mixture containing precipitated metal values; heating said mixture containing precipitated metal values to evaporate volatile material from said mixture, leaving a dry powder containing said metal values. The dry powder can be calcined to provide particulate metal oxide or reduced to provide particulate metal. Oxide mixtures are provided when the aqueous solution contains values of more than one metal. Homogeneous metal-metal oxide mixtures for preparing cermets can be prepared by selectively reducing at least one of the metal oxides.

DETAILED DESCRIPTION

The present invention is a method for preparing powders of controlled particle size. The method is particularly applicable to the production of powders having an average particle size less than about 15 microns in diameter. By average particle size it is meant $\Sigma N_i d_i / N$, where N is the total number of particles and $N_i$ is the number of particles having diameter $d_i$ (equivalent sphere diameter). Powder mixtures prepared according to this method are very homogeneous, having a composition variance of less than ± 1 wt. % at the 95% confidence level.

Finely divided powders are prepared according to this invention by first reacting an aqueous solution containing dissolved metal values with excess urea. The urea reacts with the water present in the solution, including water of hydration of soluble species, according to the reaction $$NH_2—CO—NH_2 + H_2O \rightleftharpoons 2NH_3 \uparrow + CO_2 \uparrow$$

The reaction of urea with water in the solution takes place at a temperature sufficient to melt the urea. Depending upon the metal salt in the solution, the urea/salt mixture melts at about 120°–132° C, whereupon urea reacts with the water forming volatile products, leaving the urea present in excess of the water content as a molten urea solution containing the metal values. The aqueous solution can be a solution of any soluble metal salt or mixture of metal salts. Preferred are metal salts such as halides, nitrites, or nitrates whose anions form volatile products upon subsequent heating with molten urea. The preferred method of carrying out the reaction is to add solid urea to a concentrated aqueous solution and heat the resulting mixture to a temperature sufficient to melt the urea. It is preferred that the initial aqueous solution be essentially saturated to minimize the amount of urea reacted.

After the reaction of water in the solution with urea is complete, as evidenced by a volume reduction representative of the original aqueous volume present (volume of water plus stoichiometric urea), the resulting molten urea solution is heated to cause metal values dissolved therein to precipitate. Metal values present in the molten urea solution precipitate homogeneously at about 180° C, forming a mixture of urea and the precipitated metal values. As the precipitation goes to completion, the temperature of the mixture rises, indicating an exothermic reaction. The exact chemical composition of the precipitate has not been determined. It is believed to be either a hydrated oxide or an amine compound. It is believed that a part of the urea in the molten urea/-metal salt mixture is decomposed as it is heated above its melting point, leaving a liquid product. For purposes of this invention, the term "molten urea" will be used to indicate the liquid phase present after the urea/water reaction and after the precipitation reaction, regardless of its actual chemical composition.

After the completion of the precipitation reaction the resulting mixture containing precipitated metal values is heated to evaporate volatile material from the mixture, leaving a dry powder containing the metal values. In actual practice, at the completion of the precipitation step, the product is virtually a solid mass of precipitate bound together with residual molten urea. The volatile products, e.g. $NH_4NO_3$, are evaporated by heating to about 400° C at atmospheric pressure.

The exact chemical composition of the dry powder has not been determined. In order to form metal from reducible metal precipitates, the dry powder is heated in the presence of a reducing gas such as hydrogen. In order to provide metal oxide particles, the dry powder can be calcined at above about 650° C. For purposes of this invention, the term calcining is used in its general sense to mean heating the dry powder to a high temperature but below its fusing point to cause it to lose moisture or other volatile material and/or to cause it to be oxidized. The product of the calcination step is a fine oxide powder or mixed oxide powder. When halide salt solutions are used, it is believed that the calcination step should be performed in the presence of oxygen. When oxysalts are used such as nitrates, sulfates, nitrates, phosphates, etc. oxygen is probably not needed for the calcination step.

It is not necessary that the heating steps of this process be carried out in a stagewise manner. All that is required is that the water in aqueous solution react with urea prior to the precipitation step and that the precipitation be complete prior to evaporating to dryness. Accordingly, it is a simple matter to devise a continuous or varying heating rate to accomplish these objectives.

Any metal cation or mixture of metal cations can be converted to oxides according to this process. The particle size of the oxide product is a function of the amount of excess urea present (excess with respect to reaction with water). Since excess molten urea is the solvent for the metal values, the greater the amount of excess urea, the smaller will be the precipitated particles. It is a matter of routine experimentation to determine the oxide/urea ratio needed to provide a particular particle size. For example, oxide particles in the 0.2–0.5 micron range are prepared from molten urea solution containing the equivalent of 20 grams metal oxide per liter of molten urea. Oxide particles in the 10–12 micron range are prepared from molten urea solution containing the equivalent of 50 grams metal oxide per liter of molten urea. The very small particle sizes obtained by the subject process and the fact that all metal species precipitate simultaneously enable it to be used to provide homogeneous oxide powder mixture, having less than ± 1 wt. % variance in composition throughout.

The following examples demonstrate the preparation of fine oxide particles and several useful articles fabricated therefrom.

EXAMPLE I

In this example an oxide powder mixture is prepared for the production of a neutron dosimeter wire consisting of a 0.1 wt. % CoO dilution in MgO. $Co(NO_3)_2$ and $Mg(NO_3)_2$ solutions were mixed in the proper proportions to provide the ultimate oxide composition. The solution contained the equivalent of 429 grams oxides as nitrates in 3 liters of water. To the mixed nitrate solution was added sufficient solid urea in proportions to achieve 20 grams of metal oxide per liter of urea. The mixture was heated to 130°–140° C for 1 hour to remove the water of dissolution and hydration, after which the temperature was raised to about 180° C for 40–50 minutes to precipitate the metal values. The molten urea containing the precipitate was heated to about 400° C in a glass vessel to evaporate volatile material leaving a dry powder. The powder was transferred to a ceramic boat and heated in air to about 800° C for 8 hours, whereupon the powder was converted to oxide. The particle size was about 0.2 microns, and the oxides were uniformly mixed. The oxide powder mixture in an amount of 400 grams was mixed with 400 grams paraffin and extruded as 2000 ft. of 0.020 in. wire for a neutron dosimeter. The wire was sintered in air at 1450° C for 8 hours. Standard photoelectric spectrometry was utilized to determine the composition of samples taken from six different locations during the extrusion of the wire. As a secondary analysis, samples were also analyzed by neutron activation analysis. The variance in the composition was less than ± 1 wt. % at the 95% confidence level.

EXAMPLE II

In this example a cermet article containing simulated fission product oxides in a nickel matrix is prepared. The fission products simulate the composition of fission products from Purex reprocessing of irradiated light water reactor fuel after a burnup of 30,000 MW days/-ton. This cermet article is useful for the immobilization of nuclear reactor fission products for long term storage. The article contains 25 volume % simulated fission product oxides and the remainder is non-radioactive nickel as a metallic matrix. The composition of the simulated fission products was as follows:

| Fission Products | (g-moles) | Corrosion Products | (g-moles) |
|---|---|---|---|
| La | $1.04 \times 10^{-2}$ | Fe | $3.15 \times 10^{-3}$ |
| Ce | $1.59 \times 10^{-3}$ | Ni | $1.2 \times 10^{-3}$ |
| Cs | $2.05 \times 10^{-3}$ | Cr | $7.4 \times 10^{-4}$ |
| Sr | $1.9 \times 10^{-3}$ | Na | $3.8 \times 10^{-4}$ |
| Zr | $3.58 \times 10^{-3}$ | | |
| Ru | $2.03 \times 10^{-3}$ | | |
| U | $4.1 \times 10^{-3}$ | | |

Plus, $Al_2O_3$ ($2.67 \times 10^{-2}$ g/cc) and $SiO_2$ ($7.02 \times 10^{-2}$ g/cc) were added to form pollucite (cesium aluminum silicate) to stabilize cesium.

The simulated fission products and nickel were dissolved as nitrates in a minimum amount of 1 M $HNO_3$, about 180 ml. Sufficient solid urea was added to provide about 20 grams of oxides per liter of urea. The solution was heated to 130°–140° C for 1 hour to remove the water of dissolution and hydration, after which the temperature was raised to about 180° C for 40–50 minutes to precipitate the metal values. All the metal values precipitated homogeneously. The molten urea mixture was heated to 400° C for sufficient time to evaporate the urea leaving a dry powder. This dried powder was heated to 800° C in air for calcining, forming a mixture of nickel oxide and simulated fission and corrosion product oxides. The dried powder was heated at 850° C for 1 hour in hydrogen atmosphere, whereupon the nickel oxide was reduced to metal powder. The metal values from simulated fission products were still present as oxides having typical particle size of 0.2 microns. The powders were homogeneously mixed. The mixture was consolidated by hot pressing at 1100° C and 4000 psi for 1 hour to form a cermet waste immobilization article containing fission products within a continuous nickel matrix. Scanning electron microscopy revealed that each oxide particle was completely surrounded by the metal matrix. For waste immobilization articles, the matrix metal can be 50 to 70 volume % of the article. If desired, a ceramic waste immobilization article can be prepared by eliminating the reduction step and hot pressing the oxide powder mixture. Cermet waste immobilization articles are substantially more ductile and thermally conductive than ceramic waste articles. The present process is particularly advantageous for preparing radioactive powders and for other applications requiring remote handling, since the solids are separated from solution by evaporation rather than filtration. Filtration processes are generally to be avoided in handling hazardous substances, e.g., nuclear fuel reprocessing operations, in order to preclude the formation of aqueous effluents.

It can be readily appreciated that other cermets or metal mixtures can be prepared by selectively reducing at least one of the oxides within an oxide mixture prepared by this process. The procedures for selectively reducing metal oxides in the presence of other metal oxides are well known in the manufacture of cermets. All that is required is that at least one of the oxides in the oxide powder mixture be reducible, i.e., thermally or with hydrogen, under conditions at which at least one of the oxides is not reducible. See, for example, Cermets, J. R. Tinklepaugh, Reinhold Publishing Company, New York (1960) pp 54–55.

EXAMPLE III

This example demonstrates the use of coprecipitated metal oxide mixture to produce a porous metal article. Nickel nitrate and magnesium nitrate were dissolved in a minimum amount of water providing the equivalent of 3.1 moles oxide per liter of solution. The proportions of the nitrates were chosen to provide an ultimate 75 volume % nickel. To the nitrate solution was added urea in sufficient amount to provide 20 grams oxide per liter of molten urea. The solution was heated as in Example I to provide a homogeneous calcined oxide mixture having a particle size of 0.2–0.5 micron. The nickel oxide was reduced to metallic nickel powder by heating in hydrogen at 850° C for one-half hour. The MgO-Ni mixture was hot pressed at 1100° C at 4000 psi for 30 minutes and rolled into a sheet 2 mm thick. Thereafter the magnesium oxide in the sheet was dissolved in acitic acid at 100° C, leaving a porous nickel plate which is useful as a porous electrode for chemical analytical applications. Such a porous structure is also useful as a contact catalyst. The pore size is directly related to the oxide particle size prepared by this process.

Of course, it can be easily seen that powders and powder mixtures prepared according to this process are useful in many other powder metallurgical or ceramic applications. Alloys of sparingly soluble metals can be prepared by reducing homogeneous oxide powder mixtures. Ceramic articles such as filters having controlled pore size can be prepared from the finely divided oxide powders. The particulate precipitate can be chemically treated to provide intimately mixed metal compounds. Based upon the teachings herein, it is apparent that the subject method can be readily adapted for use in any process utilizing particles of controlled particle size.

What is claimed is:

1. A method of preparing particulate metal or metal oxide of controlled particle size comprising:

a. contacting an aqueous solution containing dissolved metal values with excess urea at a temperature sufficient to cause urea to react with water in said aqueous solution to provide a molten urea solution containing said metal values;

b. heating said molten urea solution containing metal values to cause said metal values to precipitate forming a mixture containing precipitated metal values;

c. heating said mixture containing precipitated metal values to evaporate volatile material from said mixture, leaving a dry powder containing said metal values.

2. The method of claim 1 comprising calcining said dry powder to provide particulate metal oxide.

3. The method of claim 1 wherein said dry powder containing said metal values has an average particle size less than 15 microns.

4. The method of claim 2 wherein said aqueous solution contains values of more than one metal, whereby said particulate metal oxide is a mixture of metal oxides.

5. The method of claim 4 wherein said metal values are precipitated homogeneously from said molten urea solution and said particulate metal oxide is a homogeneous mixture of metal oxides, said mixture having a composition variance of less than ± 1 wt. %.

6. The method of claim 4 further comprising, after said calcining step, reducing at least one of said metal oxides to metal.

7. The method of claim 4 further comprising, after said calcining step, selectively reducing at least one of said metal oxides to provide a metal-metal oxide powder mixture.

8. The method of claim 4 in which said aqueous solution contains radioactive metal values and values of a non-radioactive metal.

9. The method of claim 7 in which said aqueous solution contains radioactive metal values and values of a non-radioactive metal and said non-radioactive metal oxide is reduced to provide a powder mixture containing radioactive metal oxides and non-radioactive metal.

10. The method of claim 9 in which said aqueous solution contains radioactive fission product values from the reprocessing of irradiated nuclear fuel.

* * * * *